US009644911B1

(12) United States Patent
McLean, III

(10) Patent No.: US 9,644,911 B1
(45) Date of Patent: May 9, 2017

(54) FIREARM DISABLING SYSTEM AND METHOD

(71) Applicant: DM Innovations LLC, Carlisle, PA (US)

(72) Inventor: Donald A. McLean, III, Carlisle, PA (US)

(73) Assignee: DM Innovations, LLC, Carlisle, PA (US)

( * ) Notice: Subject to any disclaimer, the term of this patent is extended or adjusted under 35 U.S.C. 154(b) by 0 days.

(21) Appl. No.: 15/056,099

(22) Filed: Feb. 29, 2016

(51) Int. Cl.
*F41A 17/06* (2006.01)

(52) U.S. Cl.
CPC ..... *F41A 17/063* (2013.01)

(58) Field of Classification Search
CPC ..... F41A 17/063; F41A 17/06; F41H 13/00
USPC ..... 42/70.11; 89/1.11
See application file for complete search history.

(56) References Cited

U.S. PATENT DOCUMENTS 3,882,323 A * 5/1975 Smolker ..... F41H 13/00 102/202.5
3,882,324 A * 5/1975 Smolker ..... F41H 13/00 102/202.5
4,196,668 A * 4/1980 Morlock ..... F41H 9/00 102/401
4,682,435 A * 7/1987 Heltzel ..... F41A 17/063 42/70.01
5,261,177 A * 11/1993 Armstrong ..... F41A 17/74 42/70.08
5,548,915 A * 8/1996 Szarmach ..... F41A 17/02 340/542
5,564,211 A * 10/1996 Mossberg ..... F41A 17/08 42/70.01
6,148,557 A * 11/2000 Lindskog ..... F41A 17/44 42/70.01
6,415,542 B1 * 7/2002 Bates ..... F41A 17/06 42/70.05
6,463,689 B1 * 10/2002 McElroy ..... F41A 17/02 42/70.08
6,615,528 B1 * 9/2003 Lindskog ..... F41A 17/00 42/70.01
8,087,551 B2 * 1/2012 Henley, II ..... F41A 13/04 206/219
9,175,934 B1 * 11/2015 Kilian ..... F41H 13/00
9,222,741 B2 * 12/2015 Koerner ..... F41A 17/42
9,222,743 B1 * 12/2015 Shah ..... F41A 17/46
2002/0112390 A1 * 8/2002 Harling ..... F41A 17/066 42/70.11
2002/0174587 A1 * 11/2002 Rumfelt ..... F41A 17/54 42/70.07

(Continued)

OTHER PUBLICATIONS

Daniel G. J., New Nanotech Set to Track, Self-Destruct, and GPS Tag Guns Wireless, Aug. 11, 2013; http://www.infowars.com/new-nanotech-set-to-track-self-destruct-and-gps-tag-guns-wirelessly/.*

*Primary Examiner* — Joshua Freeman
(74) *Attorney, Agent, or Firm* — Duane Morris LLP

(57) ABSTRACT

A firearm disabling system is disclosed. The firearm disabling system includes a control circuit configured to detect one or more operational parameters of a firearm associated with an unauthorized use scenario. A foam deployment system is in signal communication with the control circuit. The foam deployment system is configured to disable one or more mechanical functions of the firearm.

19 Claims, 10 Drawing Sheets

(56) References Cited

U.S. PATENT DOCUMENTS

| | | | | |
|---|---|---|---|---|
| 2002/0174589 | A1* | 11/2002 | Rumfelt | F41A 17/063 42/70.11 |
| 2005/0115386 | A1* | 6/2005 | LaFata | F41A 17/08 89/1.11 |
| 2006/0042142 | A1* | 3/2006 | Sinha | F41A 17/063 42/1.01 |
| 2007/0113486 | A1* | 5/2007 | Howland | A62C 2/10 52/1 |
| 2009/0084284 | A1* | 4/2009 | Martinez | B63G 9/04 102/504 |
| 2010/0269674 | A1* | 10/2010 | Brown | G08B 15/00 89/1.11 |
| 2011/0119979 | A1* | 5/2011 | Gussalli Beretta | F41A 19/01 42/1.02 |
| 2011/0239890 | A1* | 10/2011 | Spritzer | C06B 21/0091 102/332 |
| 2014/0173961 | A1* | 6/2014 | Goren | F41A 17/063 42/70.11 |
| 2014/0182179 | A1* | 7/2014 | McHale | F41A 17/48 42/70.06 |
| 2015/0247704 | A1* | 9/2015 | Levilly | F41G 3/142 89/132 |

* cited by examiner

FIREARM DISABLING SYSTEM AND METHOD

BACKGROUND

Firearm owners, government officials/entities, and property owners are increasingly looking for ways to prevent accidental and/or intentional discharge of firearms by selected persons or in selected locations. Firearm owners wish to prevent use of their firearms by unauthorized persons, such as children or thieves. Similarly, police seek to prevent the use of stolen firearms and to prevent use of an officer's weapon against the officer in an altercation. Property owners and/or governmental entities want to prevent the use of guns within a specific location, such as a school, a court house, a government building, etc.

Although some "smart gun" solutions have been proposed, the proposed systems only work for guns specifically manufactured with the smart gun components. Current proposed solutions are unable to be easily retrofitted into existing firearms. Current systems also fail to adequately disable a firearm to prevent accidental and/or criminal discharge of the firearm. Proposed smart gun solutions lack the ability to be integrated with additional tracking or disabling functions and fail to provide the necessary level of performance for everyday use by law enforcement, government, or private individuals.

BRIEF DESCRIPTION OF THE DRAWINGS

The features and advantages of the present invention will be more fully disclosed in, or rendered obvious by the following detailed description of the preferred embodiments, which are to be considered together with the accompanying drawings wherein like numbers refer to like parts and further wherein.

DETAILED DESCRIPTION

Figure 1:
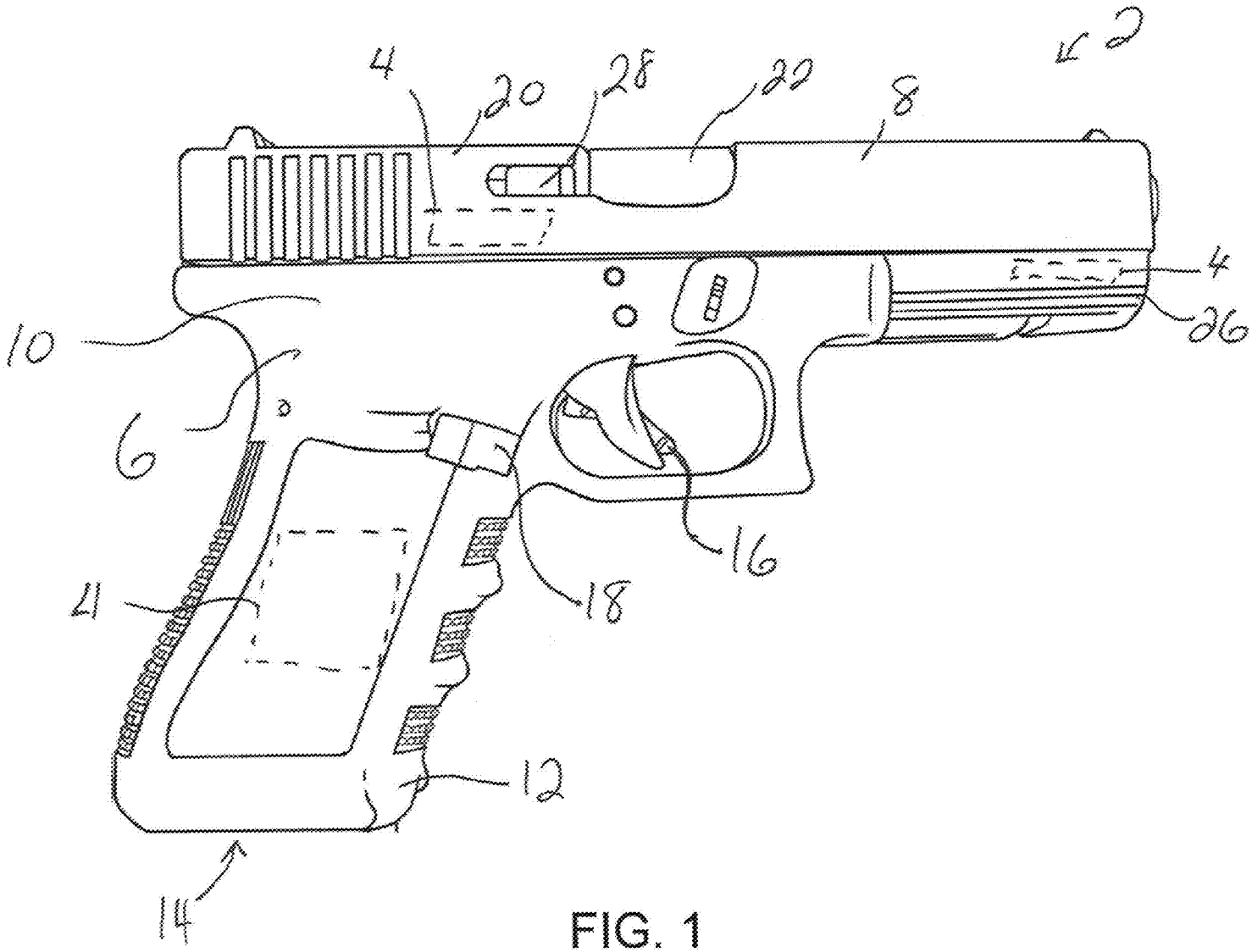
FIG. 1 illustrates one embodiment of a firearm having a firearm disabling system included therein.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected," refer to a relationship wherein structures are secured or attached to one another either directly or indirectly through intervening structures, as well as both movable or rigid attachments or relationships, unless expressly described otherwise.

In various embodiments, a firearm disabling system is disclosed. The firearm disabling system is configured to prevent operation of a firearm in one or more unauthorized use scenarios, such as, for example, use of the firearm by an unauthorized person, use of the firearm in/outside of a specific location, use of the firearm against a specific individual or group of individuals, and/or other unauthorized use scenarios. In some embodiments, the firearm disabling system includes a control circuit configured to detect an unauthorized use scenario. The control circuit can include one or more components configured to detect the unauthorized use scenario. The control circuit is in signal communication with a foam deployment system. The foam deployment system deploys a disabling foam into one or more components/spaces of the firearm to disable the firearm. For example, in some embodiments, the foam deployment system is configured to disable one or more mechanical functions of the firearm, a magazine inserted into the firearm, ammunition inserted into the firearm, and/or any other suitable portion of the firearm. In some embodiments, the control circuit is configured to activate the foam deployment system when an unauthorized use scenario is detected.

Use of a firearm is defined herein as any action involving a firearm, including, but not limited to, operation of the firearm, movement of the firearm, and/or location of the firearm. For example, in various embodiments, use of the firearm can include, but is not limited to, inserting a magazine into the firearm, loading one or more rounds of ammunition into the firearm, drawing the firearm from a holster, placing the firearm in a shooting position (e.g., shouldering the firearm, gripping the handle, etc.), cycling the firearm, cocking the firearm, discharging the firearm, activating of one or more accessories coupled to the firearm, removing the firearm from a storage location, transporting the firearm to a specific location, and/or any other suitable action involving and/or related to use of a firearm.

FIG. 1 illustrates one embodiment of a firearm 2 having a firearm disabling system 4 coupled thereto. The firearm 2 includes a frame assembly 6 and a slide assembly 8. The frame assembly 6 includes a body 10 defining a handle 12. The handle 12 defines a magazine well 14 sized and configured to receive a magazine therein (not shown). In some embodiments, a magazine well 14 is replaced and/or fitted with a permanently coupled magazine configured to receive one or more rounds of ammunition therein. A trigger assembly 16 is coupled to the body 10. A magazine release 18 is coupled to the body 10 and is configured to release a magazine from the magazine well 14. The slide assembly 8 includes a slide body 20, a barrel 22, a recoil spring, a guide rod 26, and a firing assembly 28. The firing assembly 28 can include a hammer-fired assembly and/or a striker-fired assembly. In some embodiments, the slide assembly 8 is removable from the frame assembly 6. Although the firearm 2 illustrated is a semiautomatic handgun, it will be appreciated that the firearm disabling system 2 can be coupled to and/or configured for any firearm, such as, for example, a semiautomatic handgun, a fully-automatic handgun, a semi-automatic long gun, a fully automatic long gun, a pump action firearm, a revolver, a black powder firearm, a vehicle and/or tripod mounted firearm, and/or any other suitable firearm.

In some embodiments, the firearm 2 includes a firearm disabling system 4. As shown in FIG. 1, the firearm disabling system 4 can be located in any suitable portion of the firearm 2, such as, for example, the body 10, the magazine well 14, the slide body 20, the guide rod 26, the firing assembly 28, and/or any other suitable portion. The firearm disabling system 4 is configured to prevent operation of the firearm 2 during an unauthorized use scenario. As discussed in more detail below, unauthorized use scenarios can include any situation in which a first party (e.g. firearm owner, government/law enforcement, property owner, etc.) wants to prevent use of the firearm 2. In some embodiments, the firearm disabling system 4 is configured to prevent mechanical operation of one or more components of the firearm 2 when an unauthorized use scenario is detected. For example, in some embodiments, the firearm disabling system 4 disables a mechanical function of the firearm 2 such as movement of the slide 8 with respect to the frame 6, insertion/removal of a magazine into the magazine well 14, operation of the trigger assembly 16, operation of the firing assembly 28, compression of the recoil spring, and/or any other suitable mechanical function. In some embodiments, the firearm disabling system 4 prevents one or more mechanical operations of the firearm 2 by deploying a disabling foam to one or more mechanical spaces within the firearm 2.

As shown in FIG. 1, the firearm disabling system 4 can be located in any suitable portion of the firearm 2. For example, the firearm disabling system 4 can be located in the slide 8, the handle 12, the guide rod 26, and/or any other suitable space within the firearm 2. In some embodiments, the firearm 2 can include multiple firearm disabling systems 4. In some embodiments, the firearm disabling system 4 is formed integrally with one or more components of the firearm 2, such as the frame body 10, one or more handle grips coupled to the handle 12, a guide rod 28, a slide body 20, and/or any other portion of the firearm 2. In some embodiments, the firearm disabling system 4 is a self-contained system located within and/or coupled to the firearm 2. The firearm disabling system 4 can be formed integrally with the firearm 2 during manufacture of the firearm 2 and/or can be incorporated into one or more replacement parts for the firearm 2, such as, for example, replacement hand guards, guide rods, trigger assemblies, and/or any other suitable replacement component.

Figure 2:
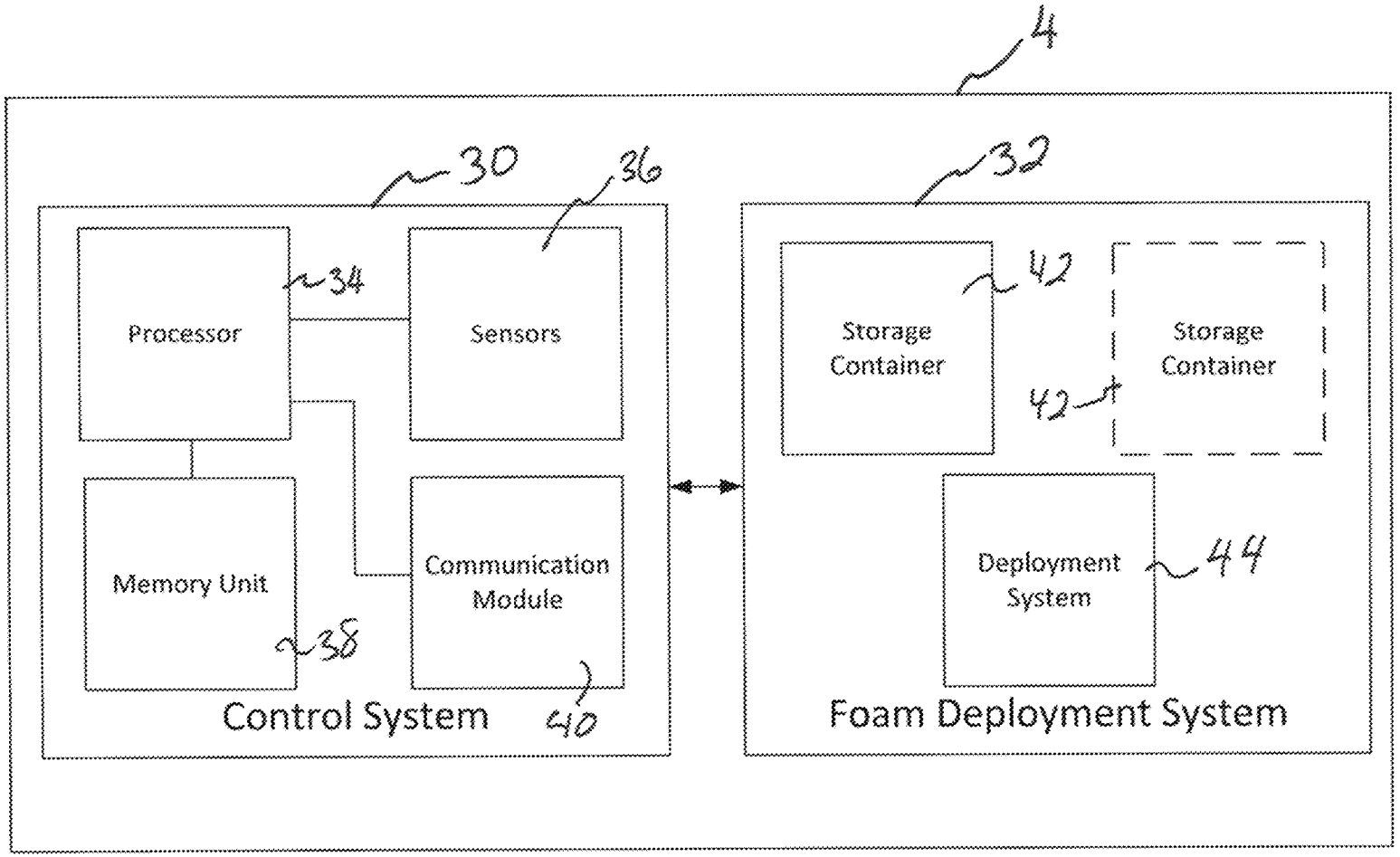
FIG. 2 is a block diagram illustrating one embodiment of the firearm disabling system of FIG. 1.

FIG. 2 is a block diagram illustrating one embodiment of a firearm disabling system 4, in accordance with some embodiments, The firearm disabling system 4 includes a control system 30 and a foam deployment system 32. The control system 30 can include one or more circuit components configured to control operation of the firearm 2 and/or the firearm disabling system 4. In some embodiments, the control system 30 is configured to perform one or more additional control and/or monitoring functions of the firearm 2 and/or the firearm disabling system 4. The control system 30 can include any suitable circuit elements for controlling and/or monitoring the firearm 2 and/or the disabling system 4, such as, for example, one or more processors 34, sensors 36, memory units 38, communication modules 40 and/or any other suitable circuit components. In some embodiments, the components of the control system 30 can be located in a single position (e.g., within a single portion of the firearm 2 and/or on a single chip/board) or can be remotely located from the other components of the control system 30 and/or the firearm 2.

In some embodiments, the control system 30 is configured to detect an unauthorized use scenario and prevent operation of the firearm 2. An unauthorized use scenario is any situation, location, event, and/or other scenario in which a first party wants to prevent operation of the firearm. For example, in some embodiments, the first party can be an owner of a firearm, law enforcement, a government official, a property owner, and/or any other suitable responsible party. Unauthorized use scenarios can include, but are not limited to, operation of a firearm by a certain person/group of people, within a certain location, and/or under certain circumstances. Although some unauthorized scenarios are discussed in detail herein, it will be appreciated that the firearm disabling system 4 can be configured to prevent operation of the firearm 2 in any unauthorized use scenario and is not limited to those scenarios specifically discussed herein.

In some embodiments, the control system 30 is configured to track one or more operational parameters of the firearm 2. For example, in some embodiments, the control system 30 is configured to track drawing/holstering, discharge, loading/unloading, position, direction, location, and/or any other suitable operational parameters. The control system 30 can include a plurality of sensors 36 configured to track the operational parameters. The tracked operational parameters can be stored on a local memory unit 38 and/or transmitted to a remote system for analysis and/or storage. For example, in some embodiments, one or more sensor 36 and/or communication modules 40 can be configured to monitor one or more of a position of a firearm 2, discharge of a firearm 2, loading of a firearm 2, handling of a firearm 2, etc. U.S. Pat. No. 8,683,727, issued Apr. 1, 2014, and entitled "Firearm Accessory Part with Tracking Capability" is hereby incorporated by reference in its entirety. In some embodiments, the control system 30 is configured to activate the foam deployment system 32 to disable the weapon when one or more predetermined operational parameters corresponding to an unauthorized use scenario are detected, as discussed in more detail below.

In some embodiments, the control system 30 is in signal communication with one or more remote systems. For example, in some embodiments, the control system 30 is in signal communication with a dash-mounted and/or body-worn recording device. When the control system 30 detects one or more predetermined operational parameters (such as drawing the of the firearm 2 from a holster), the control system 30 sends a signal to the remote device to activate one or more features thereof, such as, for example, a recording feature. In some embodiments, the control system 30 transmits one or more detected operational parameters to a remote system for storage and/or analysis.

The control system 30 is in signal communication with a foam deployment system 32. When the control system 30 detects an unauthorized use scenario the processor 34 activates the foam deployment system 32 to disable the firearm 2. For example, in some embodiments, the foam deployment system 32 is configured to disable one or more mechanical operations of a firearm 2. In some embodiments, the foam deployment system 32 is activated by an activation signal received from the control system 30. In other embodiments, the foam deployment system 32 is configured to receive an always-on signal from the control system 30 and is activated if the foam deployment system 32 fails to receive the always-on signal for a predetermined period of time. The foam deployment system 32 can be configured to disable one or more operations of the firearm 2, such as, for example, mechanical operations including disabling of a loading mechanism, a trigger assembly 16, a firing mechanism 28, a cycling mechanism, and/or any other suitable operation of the firearm 2.

In some embodiments, the foam deployment system 32 includes one or more storage containers 42 and a deployment mechanism 44. The storage containers 42 are configured to store one or more chemicals for generating a disabling foam. For example, in some embodiments, the storage containers 42 include one or more chemicals that, when released/mixed, form a quick-hardening foam. In other embodiments, the storage containers 42 can store chemicals for generating a high-density foam, a corrosive foam, and/or any other suitable disabling foam. The deployment mechanism 44 is configured to deploy disabling foam from the storage containers 42 to disable one or more mechanical operations of the firearm 2. For example, in some embodiments, the deployment mechanism 44 is configured to deploy one or more chemicals from the storage containers 42 to generate a quick-hardening, expanding foam into one or more mechanical spaces of the firearm 2. The one or more storage containers 42 can be located locally and/or remotely from the deployment mechanism 44.

In some embodiments, the deployment mechanism 44 is configured to break or rupture at least a portion of one or more storage containers 42 to generate the disabling foam. For example, in some embodiments, the storage container 42 comprises a material such as a glass, plastic, ceramic, etc. The deployment mechanism 44 includes a mechanism for breaking one or more storage containers 42, such as, for example a piston, cutting edge, a pick, a hammer-head, and/or any other suitable breaking mechanism. The deployment mechanism 44 is actuated at a force sufficient to break a portion of one or more storage containers 42, for example, by mechanical actuation, pneumatic actuation, and/or electrical actuation. In some embodiments, breaking one or more storage containers 42 allows mixing and/or release of one or more chemicals that, when mixed/released, generate a disabling foam.

In some embodiments, the deployment mechanism 44 includes a pump configured to deploy a disabling foam from the storage containers 42. For example, the deployment mechanism 44 can transport one or more chemicals from one or more storage containers 42 to a mechanical space of the firearm 2. In some embodiments, the pump is configured to pump a first chemical from a first storage container 42 and a second chemical from a second storage container 42 to a mechanical space and/or location on the firearm 2. The mixing of the first chemical and the second chemical generates a disabling foam within a mechanical space of the firearm 2.

In various embodiments, the disabling foam 46 can comprise any suitable substance configured to disable one or more operations of the firearm 2. For example, in some embodiments, the disabling foam 46 comprises a quick hardening foam. The quick hardening foam can comprise a commercially available quick hardening foam, such as, for example: Great Stuff™ produced by Dow Chemical Company, Midland, Mich.; Polyfilla Expanding Foam, produced by Poly, Australia; or Instapak Quick Packaging, produced by Sealed Air Corp., Charlotte, N.C. In other embodiments, the quick hardening foam can be a proprietary and/or custom designed quick-hardening/expanding foam. In some embodiments, the disabling foam 46 can be a high-density and/or acidic foam. Although specific embodiments of disabling foams are discussed herein, it will be appreciated that the disabling foam 46 can comprise any suitable compound configured to disable one or more operations of a firearm.

Figure 3:
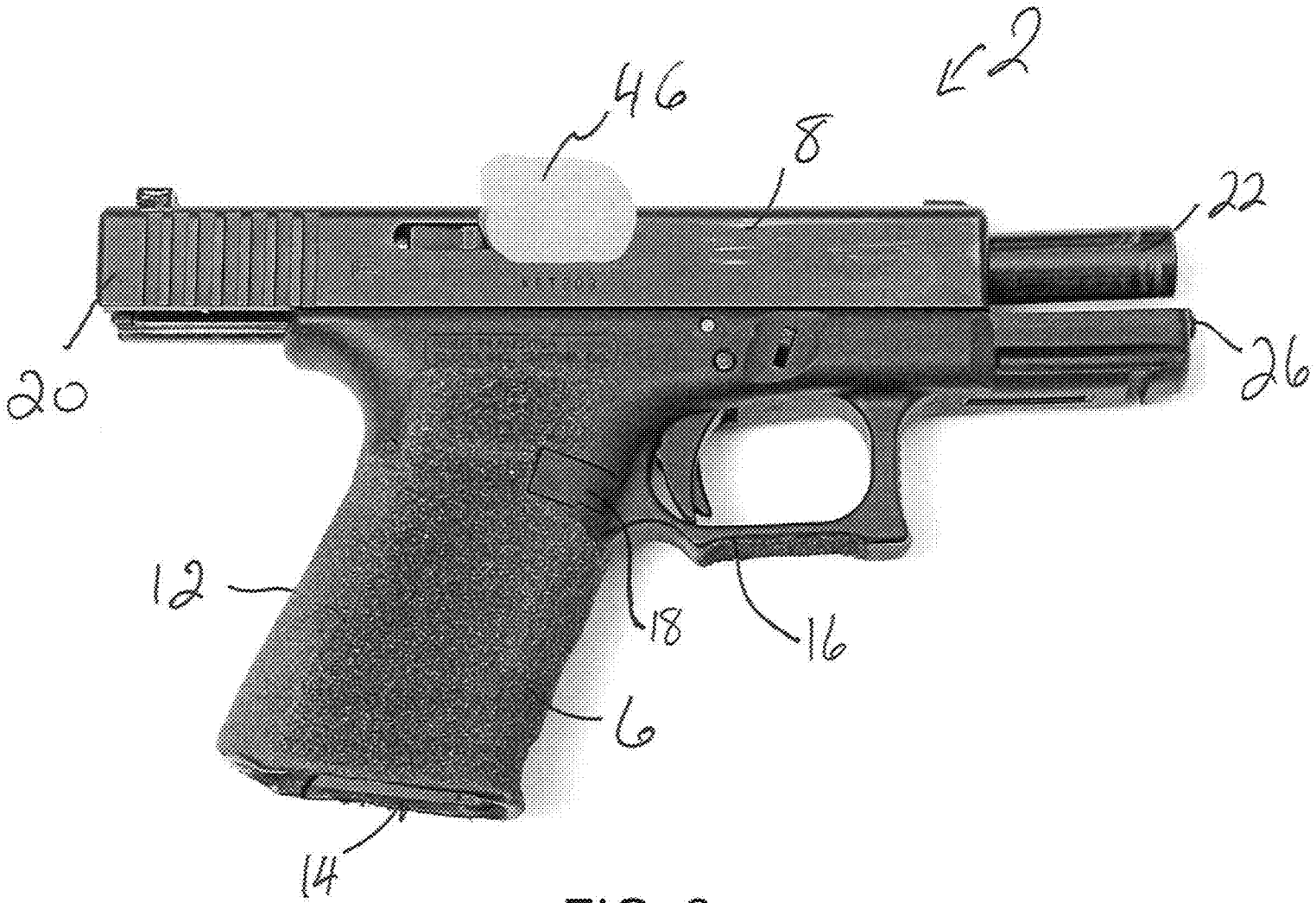
FIG. 3 illustrates one embodiment of the firearm of FIG. 1 after deployment of the firearm disabling system.

FIG. 3 illustrates one embodiment of the firearm 2 after deployment of the disabling foam 46 by the foam deployment system 32. The disabling foam 46 can be a quick-hardening foam that prevents mechanical operation of one or more portions of the firearm 2. For example, in the illustrated embodiment, the disabling foam 46 is a quick-hardening foam deployed into the action of the firearm 2 to prevent mechanical operation of a loading mechanism (e.g., movement of the slide 8, loading from a magazine, ejection of spent casings, etc.), a firing mechanism 28 (e.g., hammer/striker movement, trigger rotation, contact between the hammer/striker and a primer, etc.), and/or any other mechanical operation. The disabling foam 46 is deployed by the foam disabling system 32 in a liquid or semi-liquid state such that the disabling foam 46 can flow into mechanical spaces in the firearm 2. In some embodiments, the disabling foam 46 hardens at a predetermined rate such that operation of the firearm 2 is disabled within a predetermined time period sufficient to prevent discharge (or additional discharge) of the firearm 2. For example, in some embodiments, the disabling foam 46 is configured to disable the firearm 2 within two seconds, one second, half a second, a quarter of a second, and/or any other suitable predetermined time period. In some embodiments, the disabling foam 46 expands while hardening, allowing the disabling foam 46 to fill mechanical spaces and/or enter additional areas of the firearm 2 to prevent operation thereof. In other embodiments, the disabling foam 46 is contained within a specific mechanical space of the firearm 2 to prevent detection of the disabling foam 46 by an unauthorized user.

Although embodiments are illustrated herein having a single foam deployment system 32, it will be appreciated that the firearm 2 can be fitted with multiple foam deployment systems 32 configured to disable multiple portions of the firearm 2 sequentially and/or simultaneously. For example, in some embodiments, the firearm 2 can include a foam deployment system 32 configured to disable mechanical operation of a firing mechanism 28 and a separate foam deployment system 32 configured to disable mechanical operation of a loading mechanism (such as movement of the slide 8). Larger firearms, such as rifles, shotguns, vehicle-mounted weapons, etc., can include a greater number of foam deployment systems 32 and/or larger foam deployment systems 32.

In some embodiments, the firearm disabling system 4 is configured to disable the firearm 2 if the firearm arm disabling system 4 is removed from the firearm 2 and/or tampered with. For example, in some embodiments, the firearm disabling system 4 is formed integrally with one or more essential components of the firearm 2, such as a guide rod 26, a trigger mechanism 16, a firing mechanism 28, and/or any other essential component of the firearm 2. If the component containing the firearm disabling system 4 is removed, the firearm 2 will not function. The firearm disabling system 4 can be formed integrally with a drop-in replacement part for existing firearms and/or formed integrally with new firearms. In other embodiments, if an unauthorized user attempts to remove or disable the firearm disabling system 4, the foam deployment system 32 is activated to deploy the disabling foam 46.

Figure 4:
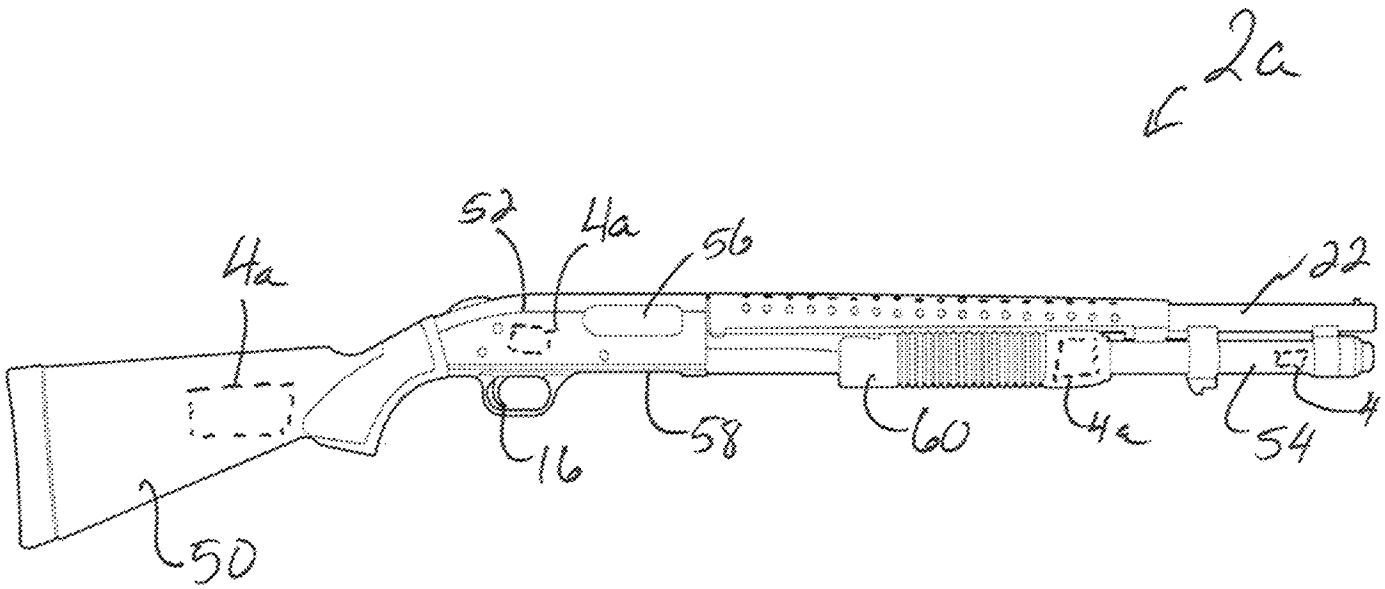
FIG. 4 illustrates one embodiment of a pump-action firearm having a firearm disabling system included therein.

FIG. 4 illustrates one embodiment of a pump-action firearm **2*a*, such as a pump-action shotgun, having a firearm disabling system 4*a* coupled thereto. The pump-action firearm 2*a* includes a stock 50 coupled to a receiver 52. A tubular magazine 54 extends from a lower portion of the receiver 52 and a barrel 22 extends from an upper portion of the receiver 52. A trigger assembly 16 is coupled to the receiver 52. The receiver 52 includes a firing assembly 28, an ejection port 56, and a magazine loading port 58. A pump handle 60 is coupled to the tubular magazine 54 to operate a loading mechanism. In some embodiments, a firearm disabling system 4***a* can be located in any suitable portion of the firearm 2*a*, such as, for example, the stock 50, the receiver 52, the tubular magazine 54, the pump handle 60 and/or any other suitable portion of the firearm 2*a*. Although embodiments of a pump-action shotgun are illustrated herein, it will be appreciated that the firearm disabling system 4*a* can be configured for use on any suitable firearm, such as, for example, a pump-action rifle, shotgun, or handgun, a breach-loading firearm, a semi-automatic magazine-fed firearm, and/or any other firearm 2.

The firearm disabling system 4*a* is configured to disable operation of one or more functions of the firearm 2*a*, such as, for example, a loading mechanism (e.g., tubular magazine 54, magazine loading port 58, pump handle 60, etc.), a firing mechanism 28 (e.g., hemmer/striker movement), a trigger mechanism 16, an ejection mechanism 56 and/or any other suitable mechanism. The firearm disabling system 4*a* is similar to the firearm disabling system 4 discussed with respect to FIGS. 1-3 above, and similar description is not repeated herein.

Figure 5:
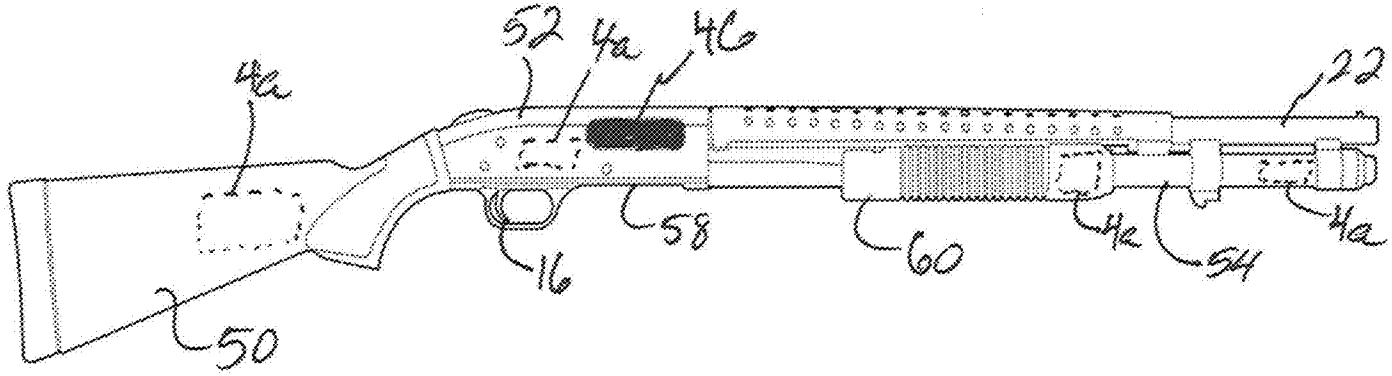
FIG. 5 illustrates one embodiment of the pump-action firearm of FIG. 4 after deployment of the firearm disabling system.

FIG. 5 illustrates one embodiment of the pump-action firearm 2*a* disabled by deployment of the firearm disabling system 4*a*. The foam deployment system 32 is configured to deploy a disabling foam 46 to disable one or more mechanical functions of the pump action firearm 2*a*, such as, for example, a loading mechanism (e.g., tubular magazine 54, magazine loading port 58, and/or pump handle 60), a firing mechanism, a trigger mechanism 16, and/or an ejection mechanism 56. In the illustrated embodiment, a disabling foam 44 is deployed into a receiver to disable one or more of a loading mechanism (e.g., movement of ammunition from the tubular magazine 54 to the receiver 52, ejection of spent shell casings etc.), a firing mechanism (e.g., movement of a hammer/striker, preventing contact between a hammer/striker and a primer, etc.), and/or any other. In some embodiments, the firearm disabling system 4*a* is located in a stock 50 of the firearm 2*a*. The disabling system 4*a* is routed into the receiver 52 through a hole drilled in the rear of the receiver 52.

Although the illustrated embodiment shows a disabling system 4*a* disabling a receiver, it will be appreciated that the disabling system 4 can be configured to disable any portion of the firearm 2. For example, in some embodiments, the disabling system 4*a* is coupled to the tubular magazine 54. If a controller 30 detects an unauthorized use scenario, the foam deployment system 32 deploys a quick-hardening foam in the tubular magazine 54 that prevents movement of the ammunition within the magazine 54 and stops further loading and/or cycling of the firearm 2*a*. Although specific embodiments are disclosed herein, it will be appreciated that the firearm disabling system 4 can be located in any suitable portion of the firearm 2*a* to disable operation of one or more mechanical functions.

Figure 6:
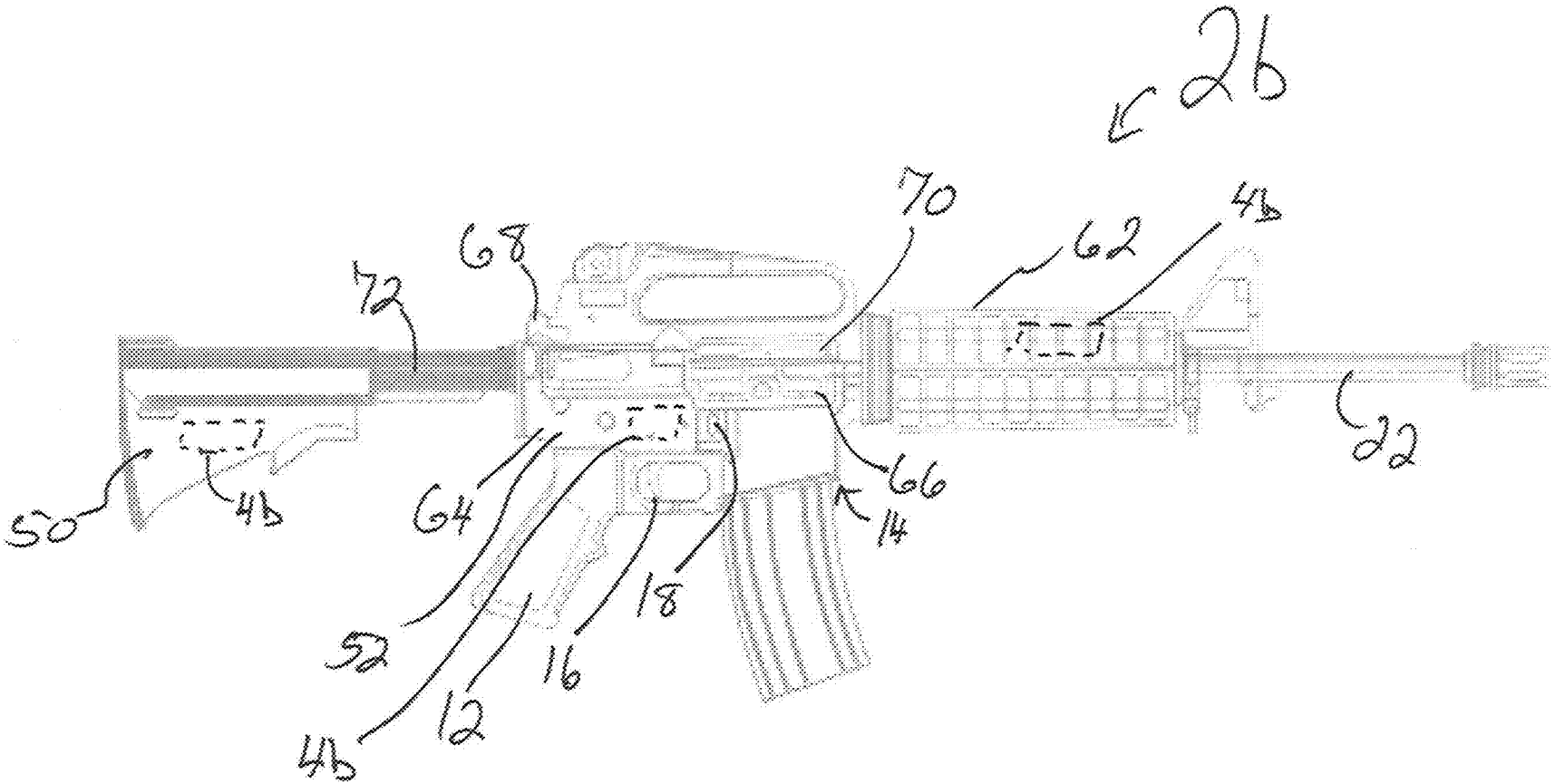
FIG. 6 illustrates one embodiment of a semi-automatic firearm having a firearm disabling system included therein.

FIG. 6 illustrates one embodiment of a semiautomatic firearm 2*b* having a firearm disabling system 4*b* incorporated therein. The semiautomatic firearm 2*b* includes an upper portion 62 and a lower portion 64. The upper portion 62 includes a dust cover 66, a barrel 22, a charging handle 68, and an ejection port 70. The lower portion 64 includes a receiver 52 defining a magazine well 14. A magazine release 18 is coupled to the receiver 52 and is configured to release a magazine (not shown) from the magazine well 14. A buffer tube 72 and a stock 50 extend from a rear portion of the receiver 52. A trigger assembly 16 is coupled receiver 52. In some embodiments, a handle 12 extends from the receiver and is located behind the trigger assembly 16.

In some embodiments, a firearm disabling system 4*b* can be located in any suitable portion of the firearm 2*a*, such as, for example, the handle 12, the stock 50, the receiver 52, the magazine well 14, the buffer tube 72 and/or any other portion of the firearm 2*b*. The firearm disabling system 4*b* is configured to disable operation of one or more of the functions of the firearm 2*b*, such as, for example, a loading function (e.g., bolt carrier, loading ramps, magazine feeding, ejection of empty casings, etc.), a firing mechanism, a trigger mechanism 16, and/or any other suitable mechanism. The firearm disabling system 4*b* is similar to the firearm disabling system 4 discussed with respect to FIGS. 1-3 above, and similar description is not repeated herein.

Figure 7:
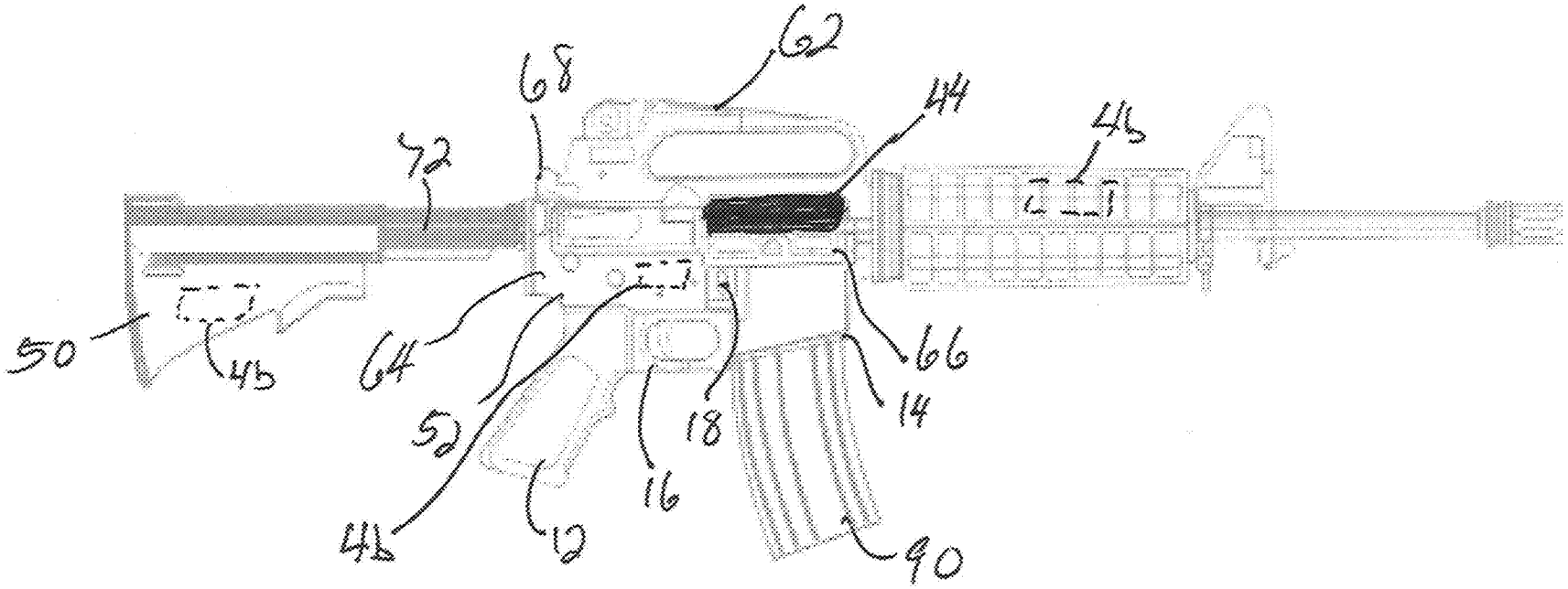
FIG. 7 illustrates one embodiment of the semi-automatic firearm of FIG. 6 after deployment of the firearm disabling system.

FIG. 7 illustrates one embodiment of the firearm 2*b* of FIG. 6 after deployment of the firearm disabling system 4*b*. A foam deployment system 32 deploys a disabling foam 46 to disable one or more mechanical functions of the firearm 2*b*, such as, for example, a loading mechanism, a firing mechanism 28, a trigger mechanism 16, and/or any other suitable mechanism. For example, in the illustrated embodiment, the foam deployment system 32 is configured to deploy the disabling foam 46 into one or more mechanical areas of the receiver 52. The disabling system 4*b* can be located in the handle 12 and connected to the receiver 52 by a hole formed in the handle 12. In other embodiments, the foam deployment system 32 can be located in one or more other portions of the firearm 2*b*, such as the stock 50, the hand guard, and/or any other portion. The deployment mechanism 44 can be configured to deploy the disabling foam 46 into the buffer tube 72, the receiver 52, the magazine well 14, and/or any other suitable portion of the firearm 2.

Figure 8:
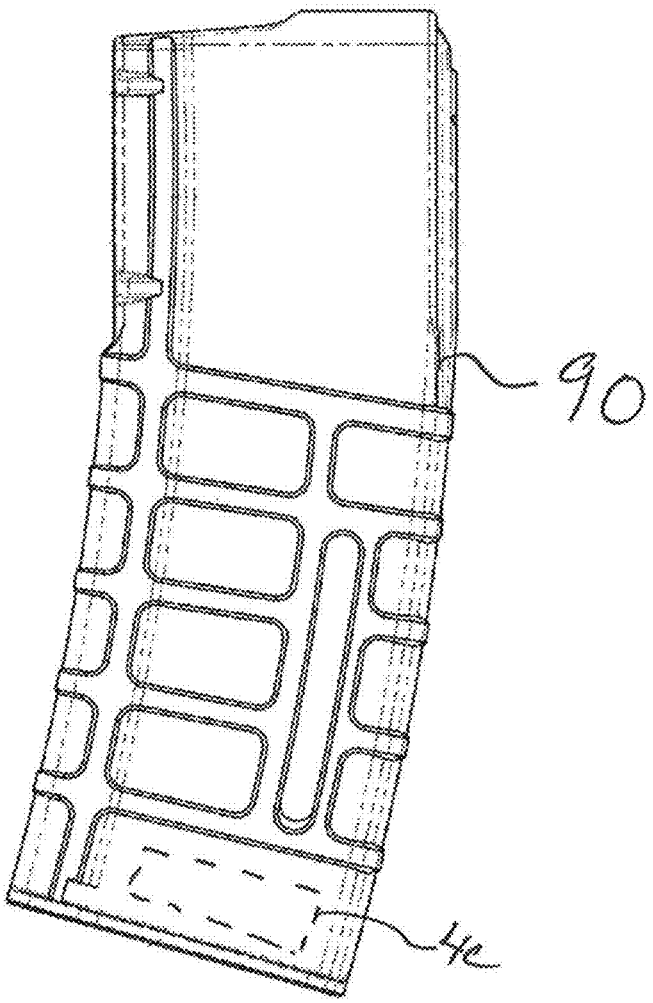
FIG. 8 illustrates one embodiment of a magazine having a firearm disabling system included therein.

In some embodiments, a firearm disabling system 4 can be located in one or more accessories attached to and/or inserted into a firearm 2. FIG. 8 illustrates one embodiment of a magazine 90 having a firearm disabling system 4*c* located therein. The magazine 90 is sized and configured for insertion into a magazine well, such as, for example, the magazine well 14 of the semi-automatic firearm 2*b* illustrated in FIG. 6. Although a specific magazine 90 is illustrated herein, it will be appreciated that the firearm disabling system 4*c* can be coupled to a magazine sized for insertion into any firearm.

When the magazine 90 is inserted into a firearm 2*b*, the firearm disabling system 4*c* is positioned to disable one or more mechanical operations of the magazine 90 and/or the firearm 2*b* during an unauthorized use scenario. For example, in some embodiments, the firearm disabling system 4*c* is configured to disable feeding of ammunition from the magazine 90 when the disabling system 4*c* is activated. As another example, in some embodiments, the firearm disabling system 4*c* is configured to disable a bolt carrier and/or extractor of the firearm 2*b*. Magazines 90 having firearm disabling systems 4*c* can be inserted into firearms with or without other firearm disabling systems 4, 4*a*, 4*b* formed integrally therein.

Figure 9:
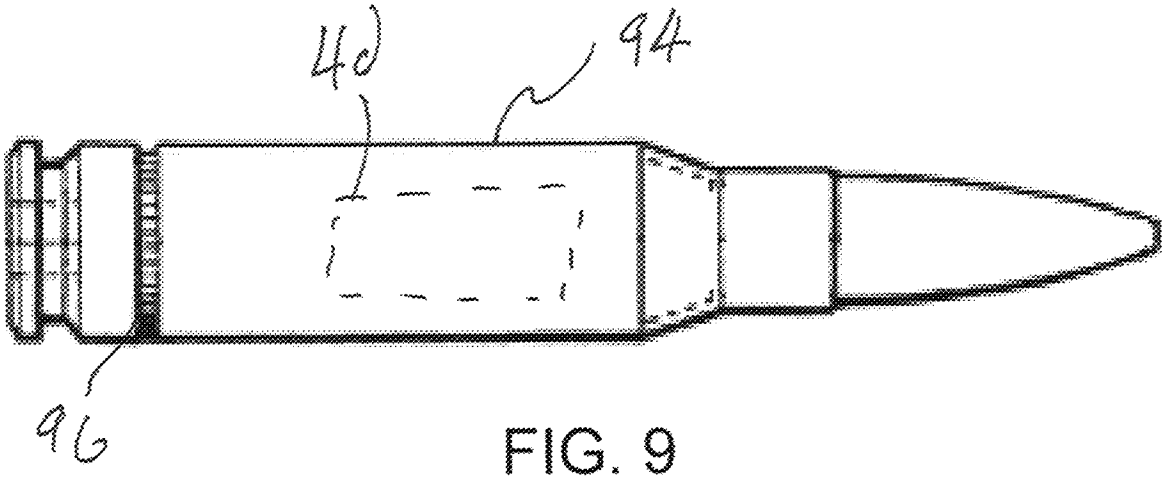
FIG. 9 illustrates one embodiment of a snap cap having a firearm disabling system included therein.

FIG. 9 illustrates one embodiment of a firearm disabling system 4*d* being located within a non-firing round of ammunition 94 (commonly referred to as a "dummy round" or "snap cap"). The snap cap 94 is sized and configured to meet the specifications of a round of ammunition, such as, for example, any handgun round such as 9 mm, 0.38, 40, 0.45, etc.; rifle round such as 5.56×45/0.223, 7.62×39, 7.62×51/0.308, 30-30, 0.30-06, etc.; a shotgun round such as a 12 gauge, 16 gauge, 20 gauge, 28 gauge, 0.410, etc.; and/or any other suitable caliber of ammunition. The snap cap 94 can be inserted into a firearm 2, 2*a*, 2*b* during storage and/or transportation. The firearm disabling system 4*d* is configured to disable one or more functions of the firearm 2, 2*a*, 2*b* if activated while loaded into a firearm. For example, in some embodiments, the firearm disabling system 4*d* is configured to disable a firing mechanism and/or loading mechanism of the firearm 2, 2*a*, 2*b*. In the illustrated embodiment, the snap cap 94 includes an outer casing 96 and a firearm disabling system 4*d* located within the outer casing 96. In other embodiments, the outer casing 96 can be part of the firearm disabling system 4*d*. For example, in some embodiments, the outer casing 96 is a storage container 42 containing one or more chemical components of the disabling foam 46. The disabling foam 46 can be deployed from the snap cap 94 into one or more mechanical spaces of the firearm, such as, for example, a receiver, a magazine, etc.

In some embodiments, the control system 30 is configured to detect an unauthorized use scenario and prevent operation of the firearm 2. An unauthorized scenario is any situation, location, event, and/or other scenario in which a first party wants to prevent operation of a firearm. For example, in some embodiments, the first party can be an owner of a firearm, law enforcement, a government official, a property owner, and/or any other suitable responsible party. Although specific unauthorized use scenarios are discussed in detail herein, it will be appreciated that the firearm disabling system 4 can be configured to prevent operation of the firearm 2 in any suitable scenario and is not limited to those scenarios described herein.

In some embodiments, the control system 30 is configured to prevent operation of a firearm 2 by an unauthorized person. For example, in some embodiments, the owner of a firearm 2 may wish to prevent operation of the firearm 2 by any person other than themselves or individuals that they grant permission to. As another example, in some embodiments, a firearm may be limited to use by one or more members of an organization, such as a law enforcement, military, private clubs, corporations, etc. In some embodiments, the control system 30 includes one or more sensors 36 configured to detect an authorized/unauthorized user and disable the weapon when an unauthorized user is detected.

In some embodiments, the one or more sensors 36 include a short-range receiver such as, for example, a Bluetooth receiver, a near-field communication (NFC) receiver, a radio-frequency identification (RFID) receiver, a Wi-Fi receiver, and/or any other short-range communication receiver. The short-range communication receiver is paired with a short-range transmitter located on or near an authorized user. For example, in some embodiments, an authorized user has a short-range transmitter located in one or more articles of clothing, accessories, and/or jewelry worn by the authorized user, such as, a ring, a wristband, a necklace, a holster, a duty belt, a uniform, a biometric implant and/or any other suitable worn article. The control system 30 is configured to detect an authorization signal transmitted by the short-range communication transmitter and received by the short-range communication receiver. If the firearm is operated without receiving the authorization signal, e.g., is located outside of the transmission range of an authorization transmitter during loading, cycling, firing, drawing, movement, and/or other operation of the firearm 2, the control system 30 activates the foam deployment system 32 to disable operation of the firearm 2.

In some embodiments, the one or more sensors 36 include a biometric sensor, such as, for example, a fingerprint sensor, a handprint sensor, a microphone (for voice capture), a DNA sensor, a hand geometry sensor, and/or any other suitable biometric sensor. A memory unit 40 is coupled to the processor 34 and stores one or more biometric signatures therein. When a user interacts with a firearm 2, for example, picks up the firearm 2, loads the firearm 2, cycles the firearm 2, discharges the firearm 2, etc., the biometric sensor detects one or more biometric signatures of the user. If the detected biometric signatures do not match signatures stored in the memory unit 40, the control system 30 can activate the foam deployment system 32 to disable the firearm 2.

In some embodiments, the control system 30 is configured to disable a firearm 2 if an unauthorized individual removes the firearm 2 from a storage location. For example, in some embodiments, a firearm 2 is stored in a predetermined storage location such as a safe, storage locker, armory, and/or other predetermined storage space. The storage space has a transmitter located in and/or near the storage space, such as in the wall of the safe, the wall of the armory, just outside the safe/armory, and/or in any other suitable position. The transmitter is configured to generate an authorized space within and/or slightly outside of the storage location in which a firearm 2 receives an authorization signal. If a firearm 2 is removed from the storage location and/or the storage location is opened in an inappropriate manner (e.g., forced open), the firearm 2 stops receiving the authorization signal and the control circuit 30 activates the foam deployment system 32 to disable the firearm 2.

In some embodiments, the control system 30 is configured to prevent operation of a firearm 2 within a predetermined exclusion zone. For example, in some embodiments the one or more sensors 36 include a receiver. The receiver can be any suitable receiver, such as, for example, a short-range receiver (e.g., a Bluetooth receiver, a near-field communication (NFC) receiver, a radio-frequency identification (RFID) receiver, a Wi-Fi receiver, etc.), a long-range receiver (e.g., global positioning satellite receiver, CDMA receiver, LTE receiver, etc.), and/or any other suitable receiver. The receiver 36 is configured to receive a signal indicative of the firearm 2 being located within a predetermined exclusion zone.

Figure 10:
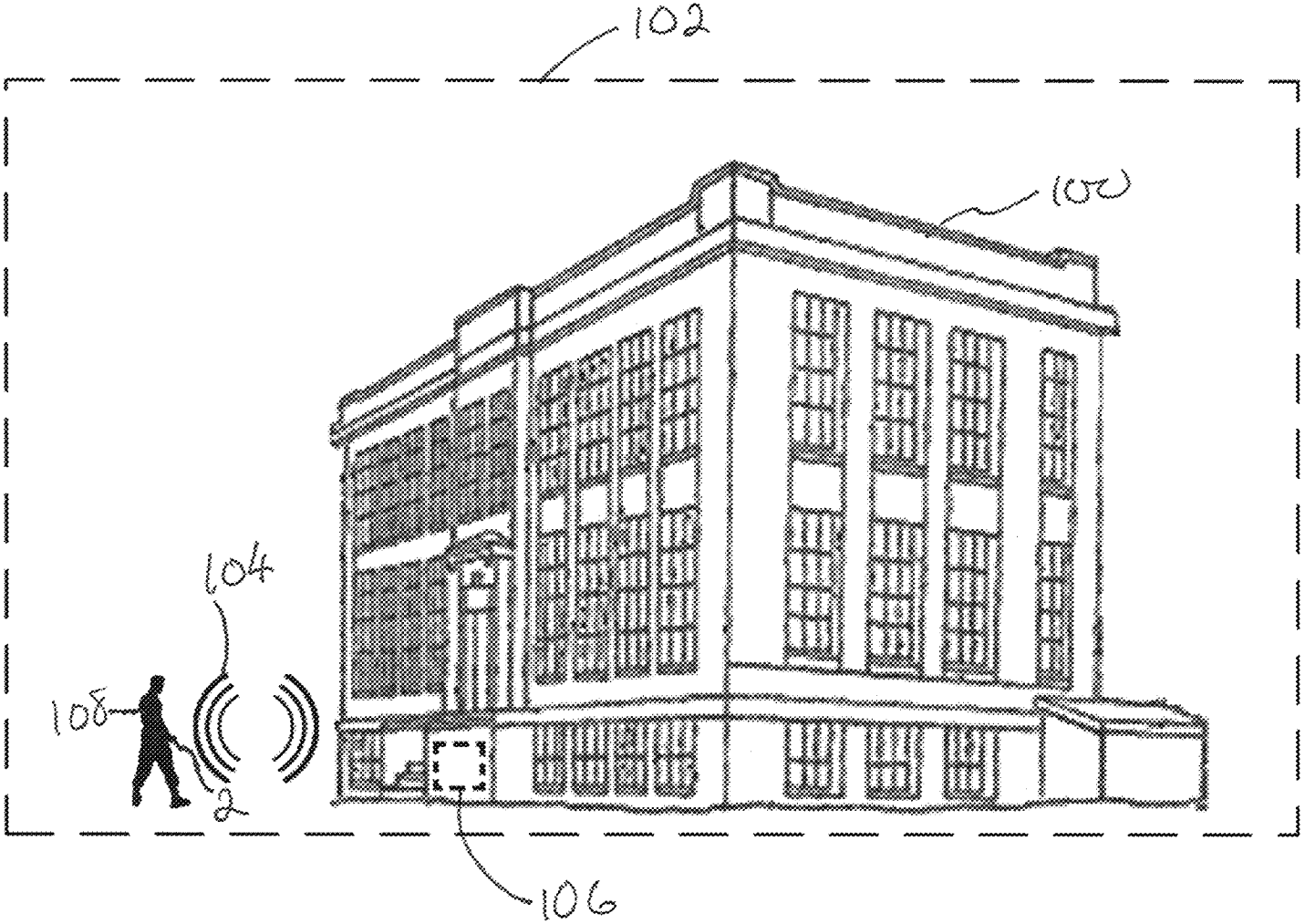
FIG. 10 illustrates one embodiment of a building having an exclusion zone located in and/or near the building.

FIG. 10 illustrates one embodiment of a building 100 having an exclusion zone 102 located in and/or near the building 100. The exclusion zone 102 is defined by one or more geographical boundaries, such as, for example, the property of the building 100, the physical footprint of the building 100, and/or any other geographical boundary. In some embodiments, the exclusion zone 102 is defined by an exclusion signal 104 transmitted by one or more transmitters. In some embodiments, the transmitter is a local transmitter 106. The local transmitter 106 can be located in and/or near the building 100, such as, for example, a building, a sign post, an enclosure (e.g., buried, located on top of a structure, etc.), and/or any other suitable location. The transmitter 106 is a short-range transmitter that generates an exclusion signal 104 using one or more short-range communication protocols, such as, for example, Bluetooth, near-field communication (NFC), radio-frequency identification (RFID), Wi-Fi, etc. When a firearm 2 including a firearm disabling system 4 enters the exclusion zone 102, the communication module 40 of the firearm disabling system 4 receives the exclusion signal 104. The processor 34 receives the exclusion signal 104 from the communications module and identifies the presence of the firearm 2 within the exclusion zone 102. In some embodiments, if the user 108 is not authorized to carry a firearm 2 within the exclusion zone 102, the processor 34 activates the foam deployment system 32 to disable the firearm 2. As another example, in some embodiments, the storage location includes a keypad and/or other electronic access device. The control system 30 can be configured to disable a firearm 2 if an incorrect access signature (such as a biometric signature, numeric sequence, etc.) is input into the electronic access device a predetermined number of times. For example, in some embodiments, if an incorrect access signature is provided to an electronic access device three or more times, the electronic access device transmits a signal to the control system 30 which disables the firearm 2. In other embodiments, if the storage location is opened without using the electronic access device (such as due to theft), the control system 30 disables the firearm 2.

In some embodiments, the exclusion zone 102 is defined by an exclusion signal 104 generated by a remote transmitter. For example, in some embodiments, the exclusion signal 104 is a global positioning satellite (GPS) signal transmitted by one or more GPS satellites. The GPS location of the building 100 is incorporated into a list of known exclusion zones 104. The known exclusion zones can be stored locally in the memory 38 of the firearm disabling system 4 and/or remotely from the firearm disabling system 4. The communication module 40 receives a GPS signal from one or more GPS transmitters (not shown). The processor 34 compares the received GPS information received to the location of known exclusion zones 104. If the GPS information indicates the firearm 2 is located within an exclusion zone 104, the processor 34 can activate the firearm disabling system 4 to disable the firearm 2. In some embodiments, multiple signals, such as, for example, a GPS signal and an LTE signal, can be received and used to determine the presence of a firearm 2 within a predetermined exclusion zone 104.

In some embodiments, the firearm disabling system 4 is configured to disable the firearm 2 when the firearm 2 is located within an exclusion zone 104. In other embodiments, the firearm disabling system 4 is configured to disable the firearm 2 when one or more operations of the firearm 2 are performed within the exclusion zone 104. For example, in some embodiments, the mere presence of a firearm 2 within the exclusion zone 104 is not enough, on its own, to activate the firearm disabling system 4. An additional action, such as drawing the firearm from a holster, loading the firearm, discharging the firearm, etc., is required to activate the firearm disabling system 4. If the one or more operations of the firearm 2 are performed within the exclusion zone 104, the firearm disabling system 4 is activated to disable the firearm 2.

In some embodiments, the control system 30 is configured to prevent operation of the firearm 2 outside of a predetermined authorized use zone. For example, in some embodiments, communications module 40 is configured to receive a short-range transmission such as, for example, a Bluetooth transmission, a near-field communication (NFC) transmission, a radio-frequency identification (RFID) transmission, a Wi-Fi transmission, etc. The communication module 40 receives a short-range authorization signal when located within a predetermined location, such as, for example, a firearm training facility, a residence, etc. If a user attempts to operate the firearm 2 outside of the authorized use zone (e.g., the user operates the firearm 2 when the communication module 40 is not receiving an authorization signal) the processor 34 can activate the firearm disabling system 4. In some embodiments, if the communications module 40 does not receive the authorization signal for a predetermined period of time, the firearm disabling system 4 is activated to disable the firearm 2.

For example, in some embodiments, the receiver 36 is a short-range receiver. A short-range transmitter can be located on and/or within any structure at or near the authorized use zone, such as, for example, a building, a sign post, an enclosure (e.g., buried, located on top of a structure, etc.), and/or any other suitable structure. The transmitter transmits the authorization signal and the receiver 36 receives the signal while the firearm 2 is located within the authorized use area. If the firearm 2 is removed from the authorized use area, the receiver 36 stops receiving the authorization signal (e.g., moves out of range of the transmitter). If the receiver fails to receive the authorization signal for a predetermined period of time, the processor 34 can activate the firearm disabling system 4 to disable the firearm 2 as discussed above.

As another example, in some embodiments, the receiver 36 is a long-range receiver, such as a GPS receiver. The receiver 36 receives a positioning signal from one or more transmitters. The processor 34 compares the position information received at the receiver 36 to the location of known authorized use areas. If the position information received by the receiver 36 indicates the firearm 2 is located outside of an authorized use area, the processor 34 can activate the firearm disabling system 4 to disable the firearm 2. In some embodiments, the authorized use zone can include a building and/or a parcel of property, such as, for example, a training academy, a firing range, a military base, and/or any other suitable structure or area. In some embodiments, multiple signals, such as, for example, a GPS signal and an LTE signal, can be received and used to determine the location of a firearm 2.

In some embodiments, the control system 30 is configured to disable a firearm 2 when one or more specific operational parameters are detected. For example, in some embodiments, the control system 30 can be configured to disable the firearm 2 when the firearm 2 is pointed in a specific direction, such as at the owner/officer associated with the firearm 2, a specific group of people (e.g., all police officers), and/or any other specific direction. The firearm 2 is associated with a specific person, such as, for example, a police officer, military serviceman, private owner, etc. After being associated with the specific person, the firearm 2 is configured to track the location and/or direction of the firearm 2 with respect to the associated person. If the firearm 2 determines that the firearm 2 is aimed at (e.g., the barrel of the firearm 2 is pointed in the direction of) the associated person while being operated (e.g., loaded, discharged, etc.), the control system 30 activates the disabling system 32 to disable operation of the firearm 2. The control system 30 can include at least one sensor 36 configured to detect a direction of the firearm 2 and/or a person associated with the firearm 2, such as, for example, a gyroscope, a short range receiver (e.g., Bluetooth, NFC, etc.), a long range receiver (e.g., GPS, etc.), and or any other suitable sensor 36. In some embodiments, the firearm 2 is associated with a group of people, such as a group of law enforcement officers and is configured to track the location and/or direction of the firearm 2 with respect to each member of the group.

In some embodiments, the control system 30 is configured to disable the firearm 2 when a disable signal is received from a remote monitoring station. For example, in some embodiments, the firearm disabling system 4 is formed integrally with one or more mechanical systems of the firearm 2, such as, for example, a firing system 28, a trigger system 16, and/or a loading system. The control system 30 can include a transceiver configured to receive location information from one or more remote transmitters, such as, for example, a GPS transmitter. The location of the firearm 2 can be transmitted to a remote monitoring station. One or more individuals, such as, for example, a member of law enforcement, can track the location of the firearm 2 through the remote monitoring station. If the one or more individuals determine that the firearm 2 has entered and/or exited a predetermined area, the monitoring station can transmit a disable signal to the firearm 2 to activate the firearm disabling system 4 to disable the firearm 2. For example, in some embodiments, a firearm disabling system 4 can be installed in one or more firearms used during a law enforcement sting operation. The location of the firearm 2 can be tracked following a controller sale and used to identify one or more members of a criminal enterprise. If a monitoring station determines that the firearm 2 is being used to commit a crime and/or has left a predetermined area, law enforcement can activate the firearm disabling system 4 to disable the firearm 2.

In some embodiments, a firearm disabling system is disclosed. The firearm disabling system includes a control circuit configured to detect one or more operational parameters of a firearm associated with an unauthorized use scenario. A foam deployment system is in signal communication with the control circuit. The foam deployment system is configured to disable one or more mechanical functions of the firearm.

In some embodiments, a firearm is disclosed. The firearm includes a firing mechanism, a trigger mechanism, a loading mechanism, and a firearm disabling system. The firearm disabling system includes a foam deployment system configured to deploy a disabling foam. The disabling foam is configured to disable one or more of the firing mechanism, the trigger mechanism, or the loading mechanism.

In some embodiments, a firearm disabling system is disclosed. The firearm disabling system includes a firearm having a control circuit and a foam deployment system. The control circuit is configured to detect one or more operational parameters of a firearm associated with an unauthorized use scenario. The control circuit comprises at least one receiver. The foam deployment system in signal communication with the control circuit. The foam deployment system is configured to disable one or more mechanical functions of the firearm. A transmitter is configured to transmit a disabling signal within a predetermined area. The disabling signal is configured to activate the foam deployment system when received by the receiver.

Although the subject matter has been described in terms of exemplary embodiments, it is not limited thereto. Rather, the appended claims should be construed broadly, to include other variants and embodiments, which may be made by those skilled in the art.

What is claimed is:

1. A firearm disabling system, comprising:

a control circuit configured to detect one or more operational parameters of a firearm associated with an unauthorized use scenario; and a foam deployment system in signal communication with the control circuit, wherein the foam deployment system is configured to disable one or more mechanical functions of the firearm, wherein the foam deployment system comprises at least one storage container and at least one deployment mechanism, wherein the deployment mechanism is configured to deploy one or more components of the disabling foam from the at least one storage container, wherein the at least one deployment mechanism is configured to break the at least one storage container.

2. The firearm disabling system of claim 1, wherein the disabling foam comprises a hardening foam.

3. The firearm disabling system of claim 1, wherein the one or more mechanical functions of the firearm include at least one of a loading mechanism, a firing mechanism, or an ejection mechanism.

4. The firearm disabling system of claim 2, wherein the control circuit comprises a communication circuit configured to receive a signal from a transmitter, and wherein the signal is indicative of one or more operational parameters.

5. The firearm disabling system of claim 4, wherein the control circuit is configured to activate the foam deployment system when a predetermined signal is received at the communication circuit.

6. The firearm disabling system of claim 4, wherein the control circuit is configured to activate the foam deployment system if a predetermined signal is not received within a predetermined time period.

7. The firearm disabling system of claim 3, wherein the control circuit comprises at least one sensor configured to detect one or more operational parameters.

8. The firearm disabling system of claim 4, further comprising a magazine housing, wherein the foam deployment system is located within the magazine housing, and wherein the magazine housing is sized and configured for insertion into a magazine well of the firearm.

9. The firearm disabling system of claim 5, further comprising a cartridge housing sized and configured to be inserted into an action of the firearm, wherein the foam deployment system is located within the cartridge housing.

10. A firearm disabling system, comprising:

a control circuit configured to detect one or more operational parameters of a firearm associated with an unauthorized use scenario; and a foam deployment system in signal communication with the control circuit, wherein the foam deployment system is configured to disable one or more mechanical functions of the firearm, wherein the foam deployment system comprises at least one storage container and at least one deployment mechanism, wherein the deployment mechanism is configured to deploy one or more components of the disabling foam from the at least one storage container, wherein the at least one deployment mechanism comprises a pump configured to pump one or more components from the at least one storage container.

11. The firearm disabling system of claim 10, wherein the disabling foam comprises a hardening foam.

12. The firearm disabling system of claim 10, wherein the one or more mechanical functions of the firearm include at least one of a loading mechanism, a firing mechanism, or an ejection mechanism.

13. The firearm disabling system of claim 10, wherein the control circuit comprises a communication circuit configured to receive a signal from a transmitter, and wherein the signal is indicative of one or more operational parameters.

14. The firearm disabling system of claim 13, wherein the control circuit is configured to activate the foam deployment system when a predetermined signal is received at the communication circuit.

15. The firearm disabling system of claim 13, wherein the control circuit is configured to activate the foam deployment system if a predetermined signal is not received within a predetermined time period.

16. The firearm disabling system of claim 10, wherein the control circuit comprises at least one sensor configured to detect one or more operational parameters.

17. The firearm disabling system of claim 10, further comprising a magazine housing, wherein the foam deployment system is located within the magazine housing, and wherein the magazine housing is sized and configured for insertion into a magazine well of the firearm.

18. The firearm disabling system of claim 10, further comprising a cartridge housing sized and configured to be inserted into an action of the firearm, wherein the foam deployment system is located within the cartridge housing.

19. A firearm disabling system, comprising:

a control circuit configured to detect one or more operational parameters of a firearm associated with an unauthorized use scenario; and a foam deployment system in signal communication with the control circuit, wherein the foam deployment system is configured to disable one or more mechanical functions of the firearm; and a housing selected from the group consisting of:

a magazine housing sized and configured for insertion into a magazine well of the firearms; and a cartridge housing sized and configured for insertion into an action of a firearm, wherein the foam deployment system is located within the housing.

* * * * *